United States Patent [19]

Regelin et al.

[11] 4,150,817

[45] Apr. 24, 1979

[54] MIXING CHAMBER

[75] Inventors: Donald H. Regelin, Pittsburgh; Jerome A. Farrar, Ambridge, both of Pa.

[73] Assignee: Zimmermann & Jansen, Inc., Glenshaw, Pa.

[21] Appl. No.: 875,560

[22] Filed: Feb. 6, 1978

[51] Int. Cl.[2] ..... C21B 9/10

[52] U.S. Cl. ..... 266/139; 266/186; 137/604

[58] Field of Search ..... 239/399, 403; 137/602, 137/604; 266/139, 186, 187; 432/40, 216

[56] References Cited

U.S. PATENT DOCUMENTS

| | | | |
|---|---|---|---|
| 1,118,865 | 11/1914 | Johnston et al. | 137/604 |
| 1,826,776 | 10/1931 | Gunther | 239/403 |
| 2,999,647 | 9/1961 | Sosnick | 239/403 |
| 3,178,160 | 4/1965 | Walther et al. | 266/139 |
| 3,567,399 | 3/1971 | Altmann et al. | 23/277 |

*Primary Examiner*—Gerald A. Dost
*Attorney, Agent, or Firm*—Henry R. Lerner

[57] ABSTRACT

A mixing chamber for mixing hot blast exiting from a hot blast stove with cold blast from a supply thereof to provide a uniform blast mixture adapted to be introduced into a blast furnace. The chamber comprises an open ended tubular member defining openings at opposite ends thereof, one of these openings being an entry into the tubular member and the other being an exit therefrom. The entry is adapted to have introduced therethrough hot blast exiting from a hot blast stove while the exit is adapted to communicate with the blast furnace. The tubular member is provided with a pair of diametrically opposed passageways therethrough, each of which is oriented tangentially with respect to the inner surface of the tubular member. Conduit means are in fluid communication with the passageways for introducing cold blast therein from a cold blast supply and such incoming blast has imparted thereto a swirling motion which thoroughly mixes with the hot blast entering the tubular member in order to produce a uniform blast mixture adapted to pass through the exit opening on its way to the blast furnace.

3 Claims, 5 Drawing Figures

MIXING CHAMBER

BACKGROUND OF THE INVENTION

The present invention relates to a mixing chamber for use in connection with a hot blast stove system which furnishes hot blast to a blast furnace.

In such a system, a hot blast stove is first placed in an "On Gas" condition, until it has been sufficiently heated, after which an air blast is passed therethrough which is heated thereby for introduction into the blast furnace. It is highly desirable, for satisfactory operation of the blast furnace, to maintain the blast entering the furnace at a relatively constant temperature.

The cycle of a hot blast stove during which the air is passed therethrough is normally referred to as "On Blast". It is clear that at the beginning of the "On Blast" cycle, the stove is at its maximum heating capacity and as the cycle proceeds, its heating capacity gradually decreases. In order to maintain the temperature of the blast entering into the furnace at the desirable constant temperature, what is normally done is to mix into the hot blast leaving the stove a selectively adjustable amount of cold blast so that the temperature of the resultant blast mixture can be controlled. Thus, at the beginning of the "On Blast" cycle of a stove, when it is the hottest, a greater amount of cold blast is required to be mixed therewith than near the end of the cycle when the blast exiting the hot blast stove is not nearly as hot, in order to maintain the blast mixture at the desired constant temperature.

The mixing of cold blast with the hot blast exiting the stove is usually accomplished in a mixing chamber situated just prior to the entry of the mixture into the blast furnace and an example of a blast stove system in which such mixing chamber is utilized is shown in U.S. Pat. No. 3,034,775 incorporated herein by reference, particular reference being made to FIG. 1 thereof wherein the mixing chamber referred to above is identified by the reference character M.

Since the air blast entering the blast furnace is a mixture of hot and cold blast, it is most desirable that such mixture be thoroughly mixed to produce a homogeneous air blast, constant in temperature throughout its extent. Conversely, it would be most undesirable to have the air blast entering into the blast furnace, comprise of a nonuniform/homogeneous mixture continuously varying in temperature from values above the desired temperature to values below the desirable temperature.

Accordingly, it is important to provide a mixing chamber capable of creating a thoroughly mixed uniform and homogeneous mixture of hot and cold blast. It is therefore an object of the present invention to provide an improved mixing chamber adapted to provide a thorough mixture and blending of the hot and cold blast to provide a homogeneous resulting mixture having a uniform temperature for introduction into the blast furnace.

SUMMARY OF THE INVENTION

In accordance with the invention, there is provided a mixing chamber in which the hot blast is introduced axially therein and in which the cold blast is introduced transversely of the hot blast and tangentially thereto to impart to the mixture within the mixing chamber a swirling motion causing thorough mixing of the hot and cold blast whereby the mixture exiting the mixing chamber is of the desired uniform temperature throughout the extent of the mixture.

Toward such end the mixing chamber comprises essentially a tubular member, one end of which receives the incoming hot blast, which travels axially through the tubular member and which thereafter exits at the opposite end thereof. The tubular wall is provided with two substantially diametrically opposed openings through which cold blast is introduced into the tubular member. These openings are oriented relative to the tubular member so as to introduce the cold blast therein transversely of the direction of flow of hot blast and tangentially of the inner contour of the tubular member causing the entering cold blast to swirl within the tubular member and thus blend thoroughly with the hot blast to provide a highly uniform mixture at a single temperature, free of isolated pockets of air at temperatures different from other portions of the mixture. The openings are oval shaped to provide a relatively wide jet of cold blast for intermixing with a greater portion of the hot blast within the tubular member, further enhancing the thorough blending of the mixture. A jacket is provided outwardly of the tubular member defining two passageways for the incoming cold air whose destination is the previously referred to openings into the tubular member.

DESCRIPTION OF THE PREFERRED EMBODIMENT

Figure 1:
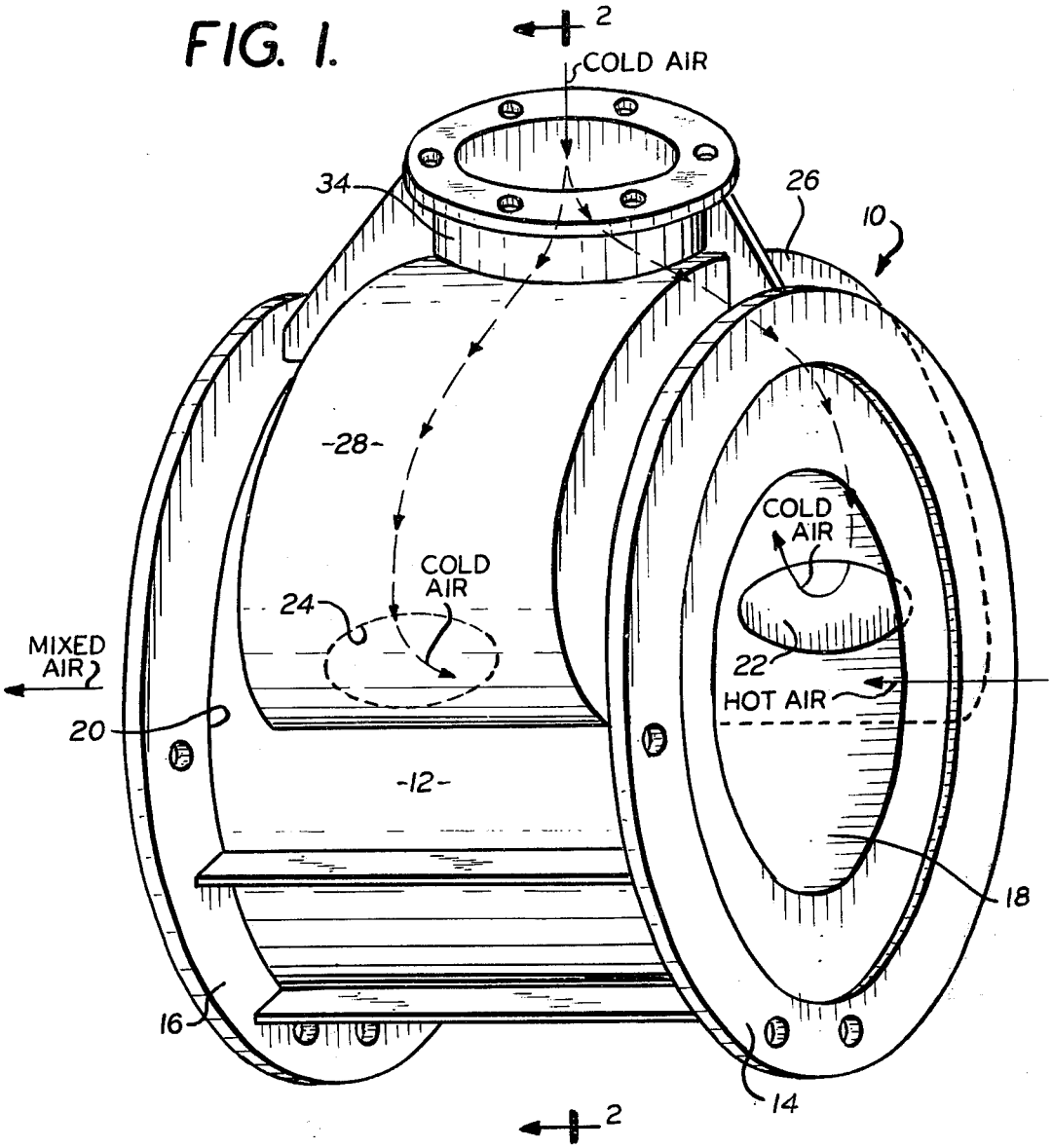
FIG. 1 is a perspective view of the mixing chamber in accordance with the invention.
Figure 2:
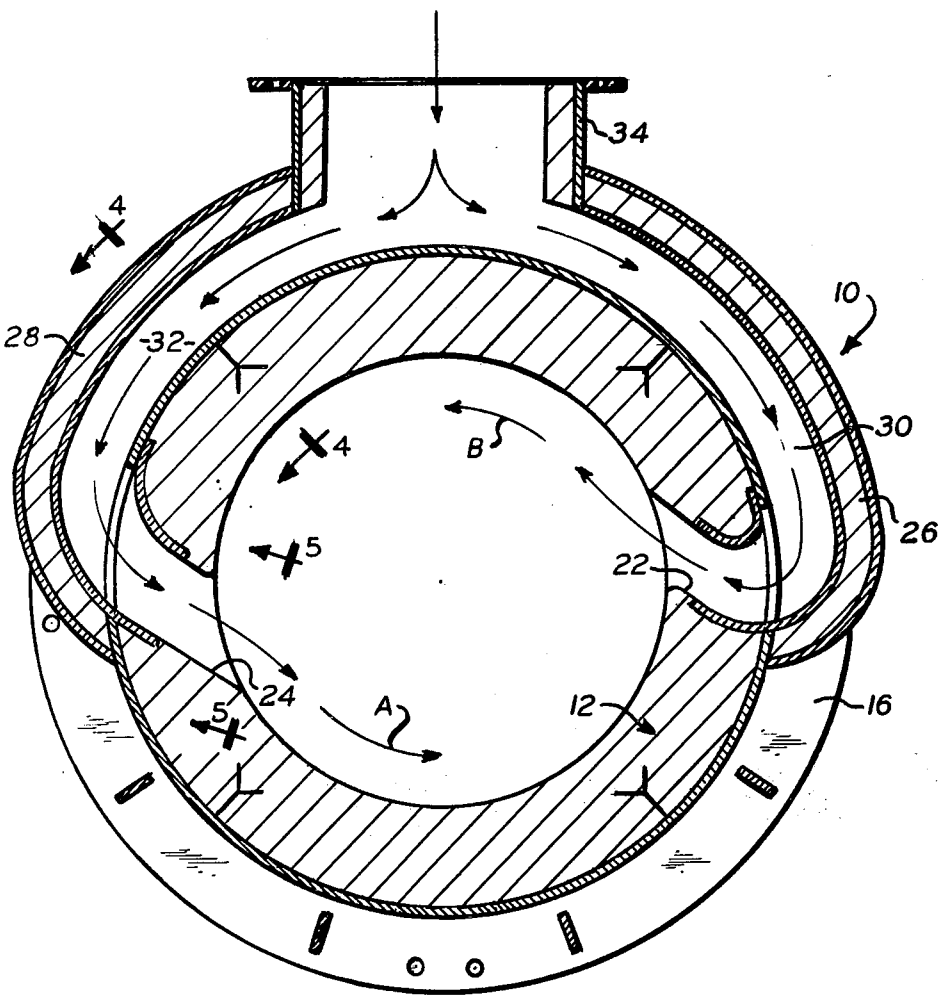
FIG. 2 is a section taken along line 2—2 of FIG. 1.

Referring now to the drawings and particularly FIGS. 1 and 2, the mixing chamber 10 in accordance with the invention is seen as comprising a central tubular member 12 provided at opposite ends thereof with mounting flanges 14 and 16. Tubular member 12 is open ended to define an entry 18 into which hot air is adapted to be introduced and an exit 20 out of which such hot air leaves the tubular member on its way to the blast furnace.

Figure 4:
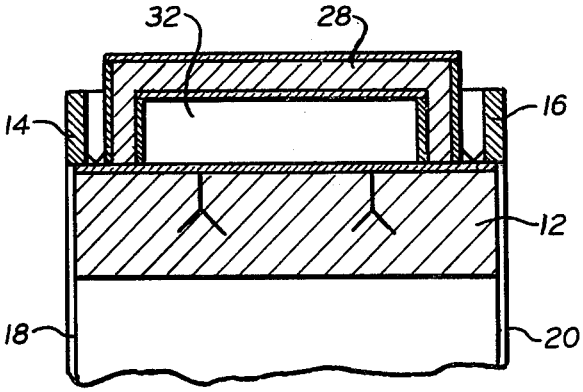
FIG. 4 is a section taken along line 4—4 of FIG. 2.
Figure 5:
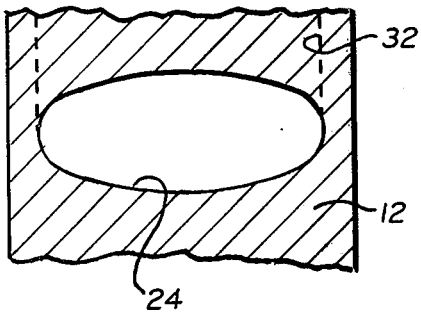
FIG. 5 is a section taken along line 5—5 of FIG. 2.
Figure 3:
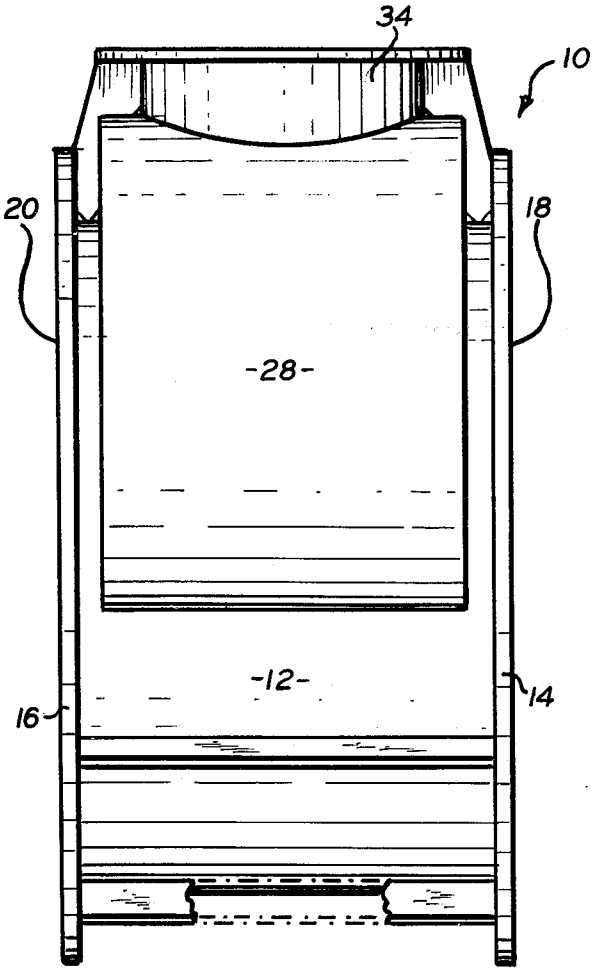
FIG. 3 is a side elevational view of the mixing chamber.

As best shown in FIGS. 2 and 5, opposite passageways 22 and 24 are provided in tubular member 12, such passageways being oval shaped, extending transversely of the direction of hot blast flow and being non-radially directed. More specifically, passageway 22 is directed in an upwardly direction which is generally tangential to the inner periphery of the chamber while passageway 24, opposite to passageway 22, is directed in a downwardly direction, also generally tangential to the inner periphery of the chamber. Opposite jackets 26 and 28 which are generally concentric with the upper part of tubular member 12, are provided thereabout to define passageways 30 and 32 in fluid communication with passageways 22 and 24, respectively. As best shown in FIG. 4, the jackets 26 and 28 are rectangular in configuration to impart to passageways 30 and 32, respectively, rectangular configurations. The upper end of the jackets terminate into an inlet tubular member 34 which defines an entry into both passageways 30 and 32.

In operation, hot blast exiting from the blast stove enters mixing chamber 10 through opening 18 thereof. At the same time, cold air at a preselected rate, automatically determined (by means not forming part of this invention), is introduced downwardly into inlet tubular member 34. The jackets being symmetrically arranged about tubular member 12, the cold blast jet introduced within tubular member 34 divides itself substantially in two with one-half of the cold blast jet travelling through passageway 32 defined between jacket 28 and tubular member 12, and thereafter into passageway 24 within tubular member 12 to force said cold air into a swirling motion in the direction shown by arrow A. At the same time, the other half of the cold blast jet travels through passageway 30 into passageway 22, thus being directed upwardly into tubular member 12, as shown by arrow B. Accordingly, the two cold blast jets enter into the mixing chamber at substantially opposite points thereof in a direction transverse to the hot blast flow and tangential to the inner periphery of the tubular member causing extensive swirling motion of the cold blast in a counterclockwise direction viewing FIG. 2, whereby the two cold blast jets become most thoroughly intermixed with the hot blast entering longitudinally of the chamber. As a result of such intermixing of the cold blast with the hot blast, there is produced within the chamber a thorough uniform and homogeneous air blast mixture at the requisite temperature, which mixture exits the chamber through aperture 20, on its way to the blast furnace.

Because of the cross-section of passageways 30 and 32, namely, rectangular in shape, and the oval shape of passageways 22 and 24, the incoming jets of cold blast are nearly as wide as the length of tubular member 12, whereby the entering cold blast engages substantially the entire hot blast content of the chamber at the time of entry, further serving to create uniformity and homogeneity of the mixture.

Thus, it is seen that the mixing chamber in accordance with the invention is eminently effective in providing a mixture of hot blast and cold blast which is uniform and homogeneous so that such mixture can be supplied to the blast furnace for optimum operation conditions.

While there is herein shown and described the preferred embodiment of the invention, it will be understood that the invention may be embodied otherwise than as herein specifically illustrated or described, and that in the illustrated embodiment certain changes in the details of construction and in the form and arrangement of parts may be made without departing from the underlying idea or principles of this invention within the scope of the appended claims.

Having thus described our invention, what we claim and desire to secure by Letters Patent is:

1. A mixing chamber for mixing hot blast exiting from a hot blast stove with cold blast from a supply thereof to produce a uniform temperature blast mixture adapted to be introduced into a blast furnace comprising, (a) an open ended tubular member defining openings at opposite ends thereof, one of said openings being an entry into the tubular member and the other being an exit therefrom, said entry being adapted to have introduced therein said hot blast exiting from a hot blast stove, said exit being adapted to communicate with said blast furnace, (b) said tubular member including a tubular peripheral wall having a pair of circumferentially spaced passageways therethrough substantially diametrically opposite to each other and of substantially oval cross section, (c) each of said passageways being oriented tangentially to the inner surface of said peripheral wall, (d) conduit means, defined by a pair of jackets generally concentric with said tubular wall, in fluid communication with said passageways, respectively, for introducing cold blast therein from a cold blast supply, (e) whereby the incoming cold blast has imparted thereto a swirling motion for thorough mixing thereof with the hot blast entering said tubular member through said entry thereto to produce a uniform temperature blast mixture adapted to pass through said exit opening on its way to said blast furnace.

2. A mixing chamber in accordance with claim 1, wherein the ends of said conduits opposite said passageways merge to form a single inlet through which said cold blast is introduced from said supply thereof.

3. A mixing chamber in accordance with claim 2, wherein each of said conduits is of generally rectangular cross section whose length is greater than half the width of said tubular member.

* * * * *